US006012975A

United States Patent [19]

Jäger

[11] Patent Number: 6,012,975

[45] Date of Patent: Jan. 11, 2000

[54] PARTICLE BLASTING NOZZLE

[76] Inventor: Anton Jäger, Dorfstrausse 9, Senden-Hittistetten, Germany, 89250

[21] Appl. No.: 08/987,173

[22] Filed: Dec. 8, 1997

[30] Foreign Application Priority Data

Dec. 9, 1996 [DE] Germany ..... 196 51 107

[51] Int. Cl.[7] ..... B24C 9/00

[52] U.S. Cl. ..... 451/87; 451/90

[58] Field of Search ..... 451/87, 88, 90, 451/99

[56] References Cited

U.S. PATENT DOCUMENTS

| | | | |
|---|---|---|---|
| 2,846,822 | 8/1958 | Steffen | 51/11 |
| 3,624,967 | 12/1971 | Kamper et al. | 51/8 |
| 4,333,277 | 6/1982 | Tasedan | 51/425 |
| 4,624,080 | 11/1986 | Jakobsson | 51/410 |
| 5,498,197 | 3/1996 | Roberts et al. | 451/94 |
| 5,667,430 | 9/1997 | McPhee et al. | 451/87 |
| 5,709,590 | 1/1998 | McPhee et al. | 451/87 |

FOREIGN PATENT DOCUMENTS

3624843A1 2/1988 Germany .

*Primary Examiner*—David A. Scherbel
*Assistant Examiner*—Dung Van Nguyen
*Attorney, Agent, or Firm*—Townsend and Townsend and Crew LLP

[57] ABSTRACT

A particle blasting nozzle has a nozzle body having an outlet opening and a suction connection with an acceleration tube extending at least partly within the nozzle body. The front end of the acceleration tube is arranged in the region of the outlet opening and its rear end has a further suction connection.

10 Claims, 1 Drawing Sheet

PARTICLE BLASTING NOZZLE

FIELD OF THE INVENTION

The present invention relates to a blasting nozzle and in particular to a particle blasting nozzle for producing a jet of sand, which can, for example, be used to remove rusty areas on metal parts.

DESCRIPTION OF PRIOR ART

In customary blasting methods, small particles or metal, plastic or stone are accelerated onto a workpiece surface with the aid of compressed air, liquid or steam, in order to achieve cleaning, roughening, smoothing, compression and consolidation of the surface and the like. Since corresponding pressure fluids are normally not available in private households, customary blasting methods have hitherto been exclusively the preserve of industrial users.

OBJECT OF THE INVENTION

It is the problem underlying the present invention (object) to provide a particle blasting nozzle which is of simple design and which can be operated without a pressure fluid source.

BRIEF DESCRIPTION OF THE INVENTION

This object is satisfied in that the particle blasting nozzle comprises a nozzle body having an outlet opening and a suction connection, and an acceleration tube extending at least partly within the nozzle body, with the front end of the acceleration tube being arranged in the region of the outlet opening and its rear end having a further suction connection.

Thus, in accordance with the invention, the particle blasting nozzle has a nozzle body having an outlet opening and a suction connection. Furthermore, an acceleration tube is provided, which extends at least partly within the nozzle body, with the front end of the acceleration tube being arranged in the region at the outlet opening and with the rear end of the acceleration tube having a further suction connection. In order to operate the particle blasting nozzle of the invention, it is only necessary to connect the suction connection of the nozzle body to a source of partial vacuum, for example a customary vat type vacuum cleaner. The further suction connection of the acceleration tube is connected to a particle reservoir in order to suck in the blasting particles and accelerate them. Through the acceleration tube provided in accordance with the invention, the sucked in blasting particles are accelerated so strongly that they emerge at the front end of the acceleration tube and impinge at high speed onto a surface to be treated. Thereafter, the particles leave the nozzle body through the suction connection and are collected in the container of the vacuum cleaner.

The particle blasting nozzle of the invention is very simply constructed and has the great advantage that it can be operated with commercially available suction apparatus, such as wet vacuum cleaners, industrial vacuum cleaners or vat type vacuum cleaners. Rusty areas can be removed without trace by means of the particle blasting nozzle of the invention, with the suction apparatus that is required as a vacuum source being available in almost every household. Thus, rusty areas on vehicle bodywork or the like can be removed effectively and without residue, without having to go to a workshop.

Advantageous embodiments of the invention are described in the specification, the figure and the subordinate claims.

In accordance with a first advantageous embodiment of the invention, the acceleration tube is led out of the nozzle body and has an air suction opening outside of the nozzle body. By providing an air suction opening of this kind, the particulate material is, on the one hand, sucked in through the acceleration tube when a source of vacuum is connected to the first suction connection, and, on the other hand, the air which is sucked in through the air suction opening produces an additional acceleration of the particular material within the acceleration tube. In this way an excellent blasting action can be produced, even with a low suction power or with a longer path between the further suction connection and the particle reservoir.

It is particularly advantageous when the air suction opening and the front end of the acceleration tube lie substantially on a straight line. In this way a linear acceleration path is achieved which accelerates the blasting particles to the highest possible speed.

In accordance with a further embodiment of the invention, the acceleration tube is of angled shape outside of the nozzle body, with the air suction opening being arranged in the vicinity of the angle portion. In this embodiment, the sucked in air and also the sucked in stream of particles are led together in a favorable manner. In this respect, it can be advantageous to make the acceleration tube straight within the nozzle body in order to avoid frictional losses and/or momentum losses.

The nozzle body of the particle blasting nozzle can be of angled shape and can be provided with grip recesses at its outer side. In this way, the handling of the particle blasting nozzle is made easier.

In accordance with a further embodiment of the invention, the further suction connection can be led into a supply container, which is connected to the nozzle body. An embodiment of this kind is very compact, because no separate particle reservoir need be provided.

The front end of the acceleration tube preferably lies within the nozzle body and is spaced a little from the outlet opening. In this way, an additional acceleration action is achieved, because a narrow region arises between the end of the acceleration tube and the nozzle body.

In accordance with a further advantageous embodiment of the invention, the length of the acceleration tube can be varied. For this purpose the acceleration tube can be formed in a plurality of parts, with one part of the acceleration tube being displaceable relative to the other part. By changing the length of the acceleration tube, the impact action of the particular material can be changed, so that the particle blasting nozzle can be adjusted for different materials or different impact objects, i.e. articles to be blasted.

It is particularly advantageous when the nozzle body has a rubber-like material in the region of the outlet opening, because in this way the particle blasting nozzle can be sealingly placed against the object to be blasted and possible damage on placement of the particle blasting nozzle can be precluded.

Finally, it is advantageous when the first suction connection is formed as a plug connection for a customary vacuum cleaner. In this way, the particle blasting nozzle of the invention can be used as an accessory or or addition to a conventional vacuum cleaner, the suction hose of which simply has to be plugged into the connection socket.

BRIEF DESCRIPTION OF THE DRAWINGS

The FIGURE shows a cross-sectional view through a preferred particle blasting nozzle in accordance with the invention, which is directed towards an object to be blasted.

DESCRIPTION OF THE EXEMPLARY EMBODIMENT

Figure 1:
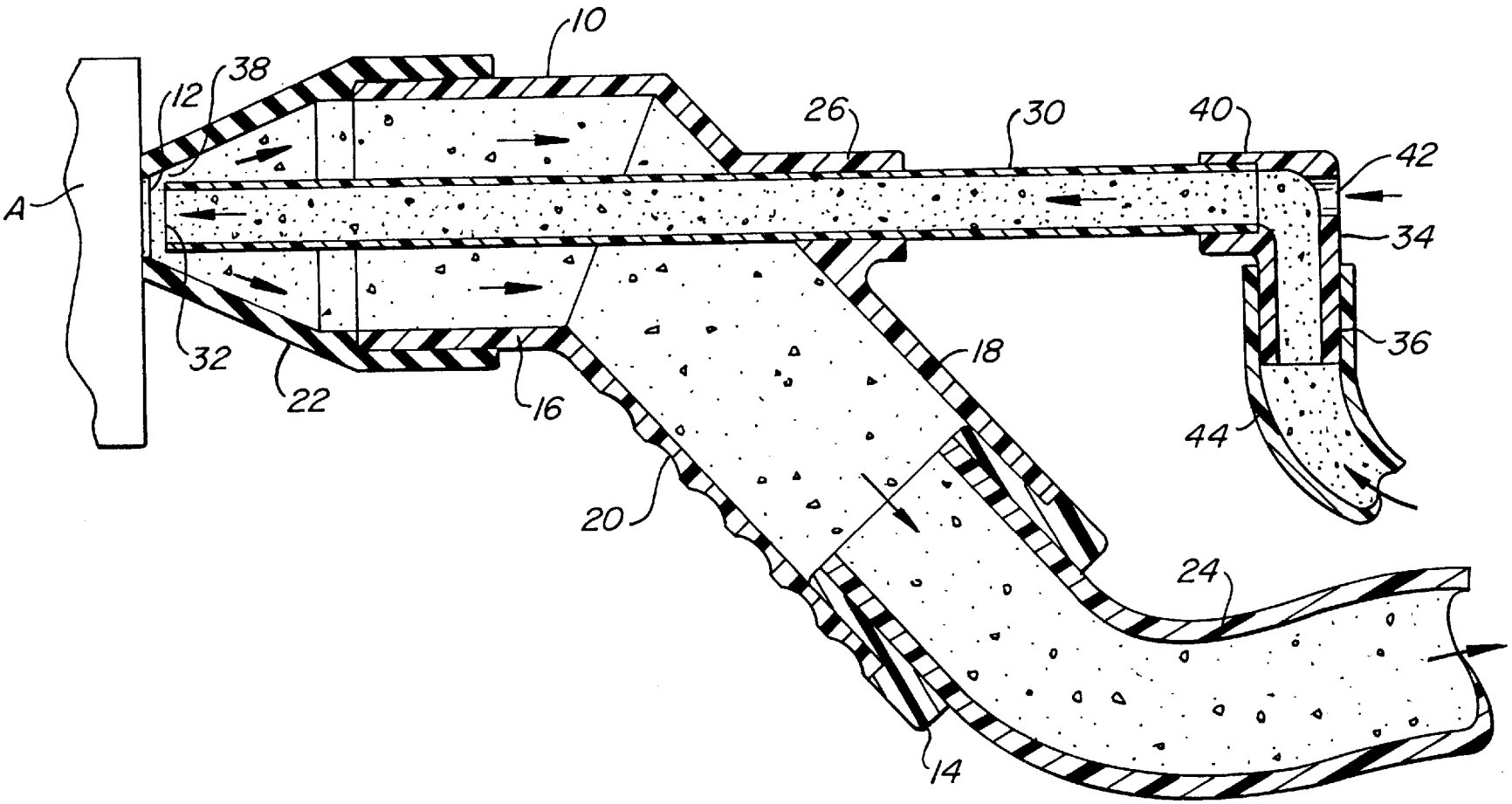

The particle blasting nozzle shown in FIG. 1 comprises a nozzle body 10 which has an outlet opening 12 and a suction connection 14. The nozzle body 10 comprises a plastic tube 16, which is angled through an angle of ca. 135° and has a handle part 18 at its angled portion, with gripping recesses 20 being provided at the outer side of the handle part.

The front region of the nozzle body is formed by a rubber cap 22, which is mounted onto the tube 16 and which tapers conically in the direction of the outlet opening 12. The suction connection 14 of the nozzle body 10 is arranged at the end of the handle part 18 of the nozzle body and is formed as a plug connection—more particularly as a socket—for receiving the suction hose 24 of a customary vat type vacuum cleaner.

A stub 26 is formed in one piece on the grip part 18 of the nozzle body 10 and has a bore in which an acceleration tube 30 is received, with the front end 32 of the acceleration tube being arranged in the area of the outlet opening 12 and with its rear end 34 having a further suction connection 36. The front end of the acceleration tube 30 is arranged within the nozzle body 10 and only slightly spaced from the outlet opening 12, so that a ring space 38 results between the front end 32 of the acceleration tube 30 and the inner jacket wall of the rubber cap 22. A plastic hose 44 is pushed onto the suction connection 36 of the acceleration tube 30 and is led into a non-illustrated particle reservoir, for example a sand container.

The rear end 34 of the acceleration tube 30 is formed in the illustrated embodiment by an L-piece 40, which has an air suction opening in the form of a bore 42. The air suction opening 42 is formed concentric to the front outlet opening 32 of the acceleration tube 30, i.e. the front end 32 and the bore 42 lie on a straight line. As can be seen, the bore 42 is arranged in the region of the angled portion of the L-piece of the acceleration tube 30. The acceleration tube 30 extends, following the bore 42, in a straight line up to its front end 32.

In the following the manner of operation of the particle blasting nozzle of the invention will be described.

In order to prepare the particle blasting nozzle for operation, a hose 24 of a customary vat type vacuum cleaner is first pushed into the socket connector 14 of the nozzle body 10. Furthermore, the hose 44 is dipped into the particle reservoir, for example a plastic container filled with quartz sand. After the nozzle body 10 has been placed onto an object A to be blasted and after the vacuum device has been set into operation, a depression first arises within the nozzle body 10, which sucks in the blasting particles via the hose 44 and the acceleration tube 30.

Through the particle stream which arises within the acceleration tube 30, air is additionally sucked in through the bore 42, which additionally accelerates the particles within the acceleration tube 30, so that these impact at high speed onto the object A to be blasted. After the impact, individual particles are led back into the vacuum device via the suction hose 24, which is indicated by black arrows.

Since the nozzle body 10 is formed of a rubber-elastic material in the region of its contact surface against the object A to be blasted, it lies sealingly against the object and does not damage the latter. In order to be able to treat specific regions of a specific size of the object to be blasted, a (non-illustrated) template can be laid onto the blasting object A, which is, for example, formed of rubber, and which has differently sized openings. In this way the blasting area can be specified and can be larger or even smaller than the outlet opening 12. At the same time good sealing is always ensured, because both the template and also the blasting head consist of a rubber-like material.

The present invention has admittedly been described in connection with sand as the blasting material. It is, however, clear to the person skilled in the art that other blasting material in addition to sand can also be used.

I claim:

1. A particle blasting nozzle comprising:

a nozzle body including an outlet opening and a suction connection; and an acceleration tube extending at least partly within the nozzle body, a front end of the acceleration tube being arranged in a region of the outlet opening and a rear end of the acceleration tube including a second suction connection, the acceleration tube extending out of the nozzle body and including an air suction opening outside the nozzle body;

wherein the second suction connection extends to a supply container that is connected to the nozzle body.

2. A particle blasting nozzle in accordance with claim 1, wherein the air suction opening and the front end of the acceleration tube lie substantially on a straight line.

3. A particle blasting nozzle in accordance with claim 1, wherein the acceleration tube is of angled design outside of the nozzle body and the air suction opening is arranged in a region of an angled portion.

4. A particle blasting nozzle in accordance with claim 1, wherein the acceleration tube extends in a straight line within the nozzle body.

5. A particle blasting nozzle in accordance with claim 1, wherein the nozzle body is of angled design and preferably has gripping recesses at an outer side.

6. A particle blasting nozzle in accordance with claim 1, wherein the front end of the acceleration tube lies within the nozzle body and is slightly spaced from the outlet opening.

7. A particle blasting nozzle in accordance with claim 1, wherein the diameter of the acceleration tube amounts to 20% to 35% of the diameter of the nozzle body.

8. A particle blasting nozzle in accordance with claim 1, wherein the length of the acceleration tube is variable.

9. A particle blasting nozzle in accordance with claim 1, wherein the nozzle body has a rubber-like material in the region of the outlet opening.

10. A particle blasting nozzle in accordance with claim 1, wherein the first suction connection is formed as a plug and socket connector for a customary vacuum cleaner.

* * * * *